US005201791A

United States Patent [19]

Clark et al.

[11] Patent Number: 5,201,791

[45] Date of Patent: Apr. 13, 1993

[54] SINGLE ALLOY SYSTEM FOR TURBINE COMPONENTS EXPOSED SUBSTANTIALLY SIMULTANEOUSLY TO BOTH HIGH AND LOW TEMPERATURE

[75] Inventors: Robert E. Clark, Orlando, Fla.; Dennis R. Amos, Rock Hill, S.C.; Robert L. Novak, Winter Springs, Fla.

[73] Assignee: Westinghouse Electric Corp., Pittsburgh, Pa.

[21] Appl. No.: 725,938

[22] Filed: Jun. 27, 1991

Related U.S. Application Data

[63] Continuation of Ser. No. 495,880, Mar. 19, 1990, abandoned.

[51] Int. Cl.[5] ..... F01K 13/00

[52] U.S. Cl. ..... 60/645; 416/241 R; 148/325

[58] Field of Search ..... 148/325, 592, 593; 415/198.1, 199.5, 200; 416/241 R; 60/645

[56] References Cited

U.S. PATENT DOCUMENTS 4,633,554 1/1987 Clark et al. ..... 29/156.4
4,762,577 8/1988 Clark ..... 148/325

FOREIGN PATENT DOCUMENTS 0083109 7/1983 European Pat. Off. .
62-189225 8/1987 Japan .

OTHER PUBLICATIONS

P. Patriarca, "Modified 9 Cr-1 Mo Steel Technical Program and Data Package For Use In ASME Sections I and VIII Design Analyses," pp. 1, 21-48; from ORNL Technology Transfer Meeting: A New Chromium-Molybdenum Steel for Commercial Applications; Apr. 1982.

*Primary Examiner*—R. Dean
*Assistant Examiner*—Margery S. Phipps

[57] ABSTRACT

This invention provides alloys having optimum high and low temperature mechanical properties for use of both the high and low pressure ends of turbine rotors in a single row power generation turbine with a service temperature profile from about 75°-1200° F. (24°-649° C.). The alloys include about 8.00-9.5 wt. % Cr and about 0.85-1.05 wt. % Mo and are heat treated at 1225°-1350° F. (663°-732° C.) for at least about one hour. The alloys and the components manufactured from these alloys preferably include a room temperature 0.2% yield strength of about 80-110 ksi (551-758 MPa).

10 Claims, 2 Drawing Sheets

SINGLE ALLOY SYSTEM FOR TURBINE COMPONENTS EXPOSED SUBSTANTIALLY SIMULTANEOUSLY TO BOTH HIGH AND LOW TEMPERATURE

This is a continuation of application Ser. No. 495,880, filed Mar. 19, 1990, now abandoned.

FIELD OF THE INVENTION

This invention relates to both high and low temperature power generation turbine applications and more particularly, to alloys and heat treatments suitable for improving these components.

BACKGROUND OF THE INVENTION

Currently employed turbine rotor alloys are designed for either high-temperature or low-temperature applications. High-temperature alloys, such as Cr-Mo-V, have superior creep and fatigue properties, while low-temperature alloys, such as Ni-Cr-Mo-V, have better yield strength. Unfortunately, turbine rotors are often exposed to both high and low temperatures at the same time, and require the superior properties of both high and low temperature alloys.

One attempt by the industry for overcoming the weaknesses in selecting a single alloy system, is to employ half sections of high-temperature Cr-Mo-V and low-temperature Ni-Cr-Mo-V alloys joined together by welding. See Clark et al., U.S. Pat. No. 4,633,554, which is hereby incorporated by reference. This technique, however, is more time consuming and generally more expensive than using a single forging. Welding defects can also occur during the manufacturing of such a rotor, which could later cause failure during service.

While attempting to develop alloys having improved high-temperature strength, toughness and corrosion resistance for pressure vessels, the Oak Ridge National Laboratory has identified a modified 9Cr-1Mo alloy (hereinafter "9Cr-1Mo mod."). See Patriarca, "Modified 9Cr-1Mo Steel Technical Program and Data Package for Use in ASME Section I and VIII Design Analysis", pp. 1, 21–48 ORNL Technology Transfer Meeting, 7 Apr. 1982, which is hereby incorporated by reference. This new alloy, now commercially available as ASTM A182, F91 has a room temperature yield strength of about 60 ksi (415 MPa) with a 20% elongation and a 40% reduction of area when normalized at about 1900°–2000° F. (1038°–1093° C.) and tempered at the specified 1350° F. (732° C.) minimum required temperature.

Prior studies have shown that turbine components made from the alloys of this invention exhibit preferred yield strengths for use in high temperature and pressure rotor applications. It has also been noted that by lowering the minimum A182, F91 tempering temperature of 1350° F. (732° C.) to a preferred range of 1275°–1300° F. (690°–704° C.), the yield strength is increased from a nominal 60 ksi (415 MPa) to a preferred 85–100 ksi (551–758 MPa). See Clark, U.S. Pat. No. 4,762,577, which is hereby incorporated by reference.

Nevertheless, there is a current need for a turbine rotor suitable for simultaneous use in high pressure and temperature and low pressure and temperature service. Such an alloy must exhibit adequate fracture toughness at about room temperature for the low temperature or ambient end of the rotor and excellent creep properties at temperatures exceeding about 800° F. (427° C.) at the high temperature end of the rotor.

SUMMARY OF THE INVENTION

Improved turbine rotors are provided which are useful in both high- and low-temperature service and all pressures. The rotors are made from 9Cr-1Mo, mod. alloy. Upon heat treating these alloys at about 1225°–1315° F. (663°–713° C.) for at least about an hour, they exhibit improved creep life, toughness, and low temperature yield strength. Turbine components manufactured from these alloys are useful in power generation turbine service temperatures of about 75°–1200° F. (24°–649° C.).

This invention also provides a method of treating a 9Cr-1Mo, mod. rotor to render it suitable for use in both low temperature and high temperature power generation turbine service. The method includes heat treating a turbine component containing this alloy at a temperature of about 1225°–1350° F. (663°–732° C.) for at least about one hour for improving the creep and yield strength of the turbine component.

BRIEF DESCRIPTION OF THE DRAWINGS

The accompanying drawings illustrate comparative test data describing the improved properties of the turbine component alloy of this invention, and in which.

DETAILED DESCRIPTION OF THE INVENTION

The present invention provides alloys suitable for use in power generation turbine service temperatures of about 75°–1200° F. (24°–649° C.). The alloys include about 8–9.5 wt. % Cr and about 0.85–1.05 wt. % Mo, and further are heat treated at a temperature of about 1225°–1350° F. (663°–732° C.) for at least about an hour, and preferably for about 5–20 hours.

The preferred chemistry for the alloys of this invention includes the following elemental ranges.

TABLE I

ASTM A182 F91 Elemental Chemistry

| Element | Range (wt %) |
|---|---|
| C | 0.08–0.12 |
| Mn | 0.30–0.60 |
| Si | 0.20–0.50 |
| P | 0.020 max |
| S | 0.010 max |
| Cr | 8.00–9.50 |
| Ni | 0.4 max |
| Mo | 0.85–1.05 |
| Cu | 0.1 max |
| V | 0.18–0.25 |
| Nb | 0.06–0.10 |
| N | 0.03–0.07 |
| Al | 0.04 max |
| Fe | Balance |

This chemistry may also include trace elements which are not specified. As will be understood by those of ordinary skill in the art, these alloys can be manufactured into turbine components using art-recognized casting and forging techniques. The principle components discussed herein are rotors for both low- and high-temperature and pressure power generation systems. One of the objectives of this invention was to produce an alloy system suitable for meeting the current design requirements of modern power-generation rotors. One of the guidelines necessary to achieve this objective was to obtain a room temperature yield strength similar to the 85-100 ksi (585-689 MPa) yield strength of Cr-Mo-V high temperature rotor alloy, and the yield strength of about 80°-110 ksi (551-758 MPa) for Ni-Cr-Mo-V low-temperature alloy. These restrictions have been adequately met by lowering the A182, F91 specified tempering temperature of 1350° F. (732° C.) to a range of about 1225°-1350° F. (663°-732° C.), more preferably to about 1275°-1300° F. (690°-704° C.), to obtain a room temperature 0.2% yield strength of about 80-110 ksi (551-758 MPa). It is understood that these optional properties can be further assured by normalizing the components at 1900°-2000° F. (1038°-1093° C.) for up to 2 hours, preferably at 1900° F. (1038° C.) for about one hour.

Figure 1:
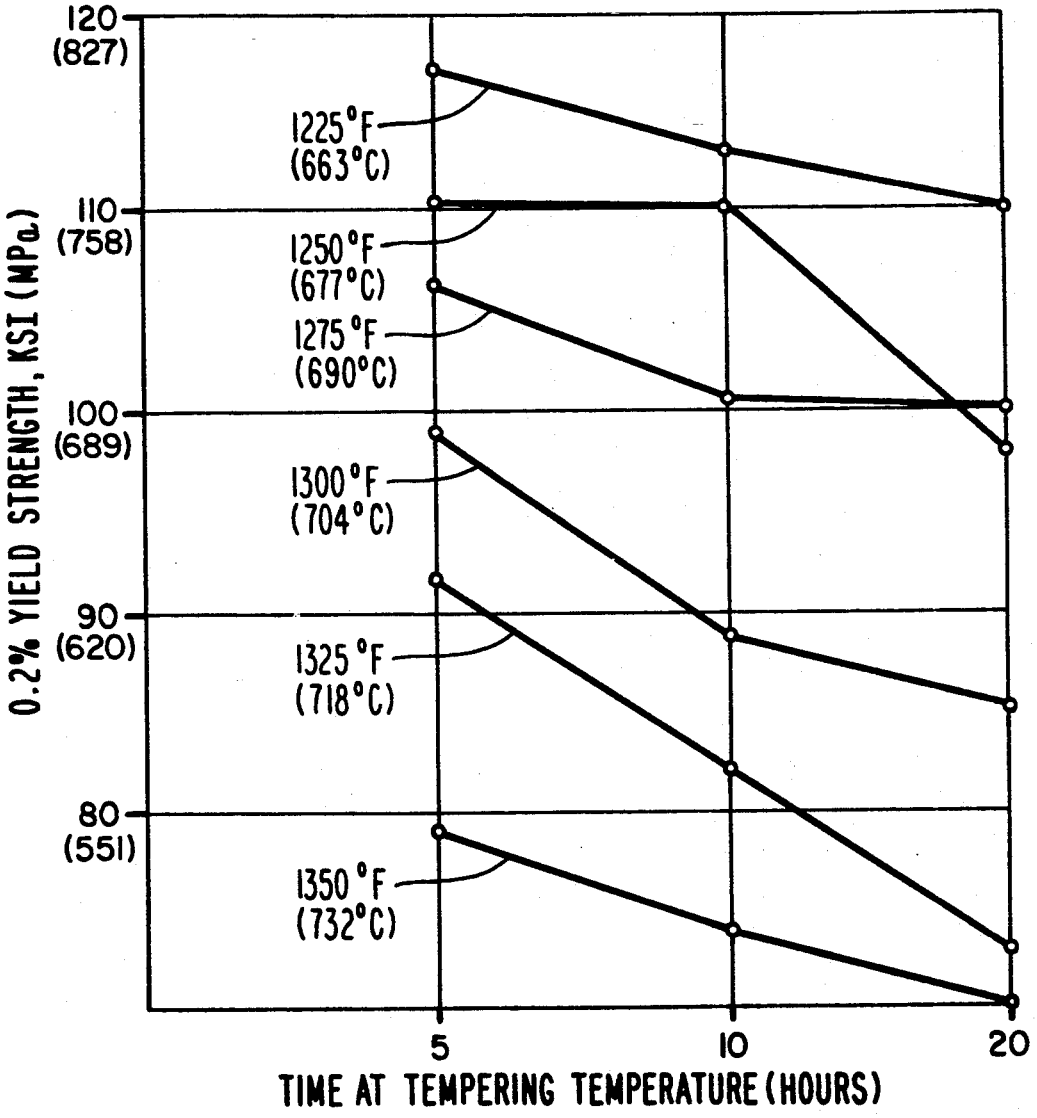
FIG. 1: is a graph of 0.2% yield strength in ksi versus tempering time in hours for the preferred 9Cr-1Mo, mod. alloy of this invention.

Results of experiments conducted on 9Cr-1Mo, mod. to define the heat treatment necessary to obtain the targeted yield strength range are shown in FIG. 1. This data illustrates the importance of tempering heat treatments on the room temperature yield strength of the alloys of this invention. The following time-temperature examples have demonstrated acceptable yield strength values for 9Cr-1Mo, mod. alloy.

TABLE II

| Time-Temperature Variables | | |
|---|---|---|
| Yield Strength KSI, (Mpa) | Temperature °F., (°C.) | Time at Temperature (hrs) |
| 101 (696) | 1275 (690) | 10 |
| 100 (689) | 1275 (690) | 20 |
| 99 (682) | 1300 (704) | 5 |
| 89 (613) | 1300 (704) | 10 |
| 85 (585) | 1300 (704) | 20 |

These examples illustrate that by lowering the specified minimum tempering temperature of 1350° F. (732° C.) to a preferred range of about 1275°-1300° F. (690°-704° C.), the yield strength of the alloy is increased from a nominal 60 ksi (415 MPa) to about 80-110 ksi (551-758 MPa). With this tempering treatment, the alloy would meet the room-temperature design requirements for both Cr-Mo-V and Ni-Cr-Mo-V alloys.

For further evaluating a preferred alloy of this invention, several plate and ring forgings, having chemistries falling within the specified ASTM A182, F91 chemistry range, were obtained, and samples were taken for mechanical testing. The following results were reported.

TABLE III

| Mechanical Testing Data Forging Samples | | | | |
|---|---|---|---|---|
| Forging | YS (0.2%) ksi (MPa) | UTS, ksi (MPa) | % El | % RA |
| Plate | 92.5 (637) | 112.0 (772) | 21.0 | 66.0 |
| Plate | 95.5 (658) | 114.0 (785) | 24.0 | 68.0 |
| Ring | 87.5 (603) | 107.0 (737) | 22.0 | 69.0 |
| Ring | 88.0 (606) | 107.0 (737) | 22.0 | 68.0 |

These samples were all tempered for about 14 hours at about 1300° F. (704° C.) and all had a yield strength that fell within the preferred range of 80-110 ksi (551°-758° C.).

Typical tensile test data for currently employed Cr-Mo-V and Ni-Cr-Mo-V alloy test samples is as follows:

TABLE IV

| Typical Mechanical Test Data for Cr—Mo—V and Ni—Cr—Mo—V alloys | | | | | |
|---|---|---|---|---|---|
| | N | 0.2% YS, ksi (MPa) | UTS, ksi (MPa) | % El | % RA |
| CrMoV | 29 | 91 (627) | 114 (785) | 19 | 54 |
| NiCrMoV | 24 | 95 (654) | 113 (779) | 22 | 68 |

When the data in Tables III and IV are compared, it can be determined that the 9Cr-1Mo, mod. alloy samples generally provided equal or improved tensile-ductility measurements at similar strength levels when compared with data for Cr-Mo-V and Ni-Cr-Mo-V alloys. It was further demonstrated that the toughness of the 9Cr-1Mo, mod. alloy samples was significantly better than conventional Cr-Mo-V alloy samples, although somewhat lower than samples prepared with Ni-Cr-Mo-V alloy.

TABLE V

| Charpy V-notch toughness data | | | |
|---|---|---|---|
| | Cr—Mo—V | NiCrMoV | 9 Cr—1 Mo, mod. |
| Energy at 75° F., ft. lb. (J) | 11 (15) | 100 (136) | 74 (100) |
| Upper Shelf Energy, ft. lb. (J) | 75 (102) | 100 (136) | 137 (185) |
| $FATT_{50}$, °F. (°C.) | 187 (86) | −130 (−90) | 70 (21) |
| Number of Forgings | 29 | 24 | 1 |

Since toughness is a critical mechanical trait for the low-temperature end of the rotor, it is important that the 9Cr-1Mo, mod. alloy be ductile around room temperature. It is therefore desired that the Fracture Appearance Transition Temperature ($FATT_{50}$) for the preferred alloys of this invention be below about room temperature, preferably less than about 80° F. (27° C.).

In the high-temperature end of the rotor, it is important for any chosen material to have acceptable creep-rupture properties. Creep-rupture data is illustrated in the following Tables VI and VII for forging samples obtained from the Oak Ridge National Laboratory and Bethlehem Steel Company.

TABLE VI

| Creep-Rupture Test Results for Forgings Obtained from Oak Ridge National Laboratory | | | | |
|---|---|---|---|---|
| TEST TEMP, °F. (°C.) | STRESS, KSI (MPa) | RUPTURE TIME, HR | ELONG, % | RED OF AREA, % |
| 950 (510) | 53 (365) | 7972 | 18 | 78 |
| 1000 (538) | 45 (310) | 5735 | 22 | 81 |
| 1050 (566) | 38 (262) | 2505 | 18 | 83 |
| 1100 (593) | 32 (220) | 869 | 40 | 82 |

TABLE VII

| Temp, °F. (°C.) | Creep-Rupture Test Results for Forgings Obtained from Bethlehem Steel Company | | | | |
|---|---|---|---|---|---|
| | Stress, KSI (MPa) | Time to Rupture, Hr | Creep Rate, %/Hour | % EL | % RA |
| 950 (510) | 53 (365) | 469 | 0.0083 | 28.2 | 79.6 |
| 950 (510) | 53 (365) | 311 | 0.013 | 29.5 | 79.7 |
| 950 (510) | 50 (344) | 1439 | 0.0024 | 26.2 | 75.7 |
| 950 (510) | 50 (344) | 1550 | 0.0023 | 20.8 | 71.5 |
| 1000 (538) | 45 (310) | 739 | 0.0055 | 27.2 | 79.6 |
| 1000 (538) | 45 (310) | 871 | 0.0046 | 30.9 | 80.9 |
| 1000 (538) | 42 (289) | 3217 | 0.0010 | 24.3 | 73.4 |
| 1000 (538) | 42 (289) | 3651 | 0.00091 | 22.3 | 76.8 |

Figure 2:
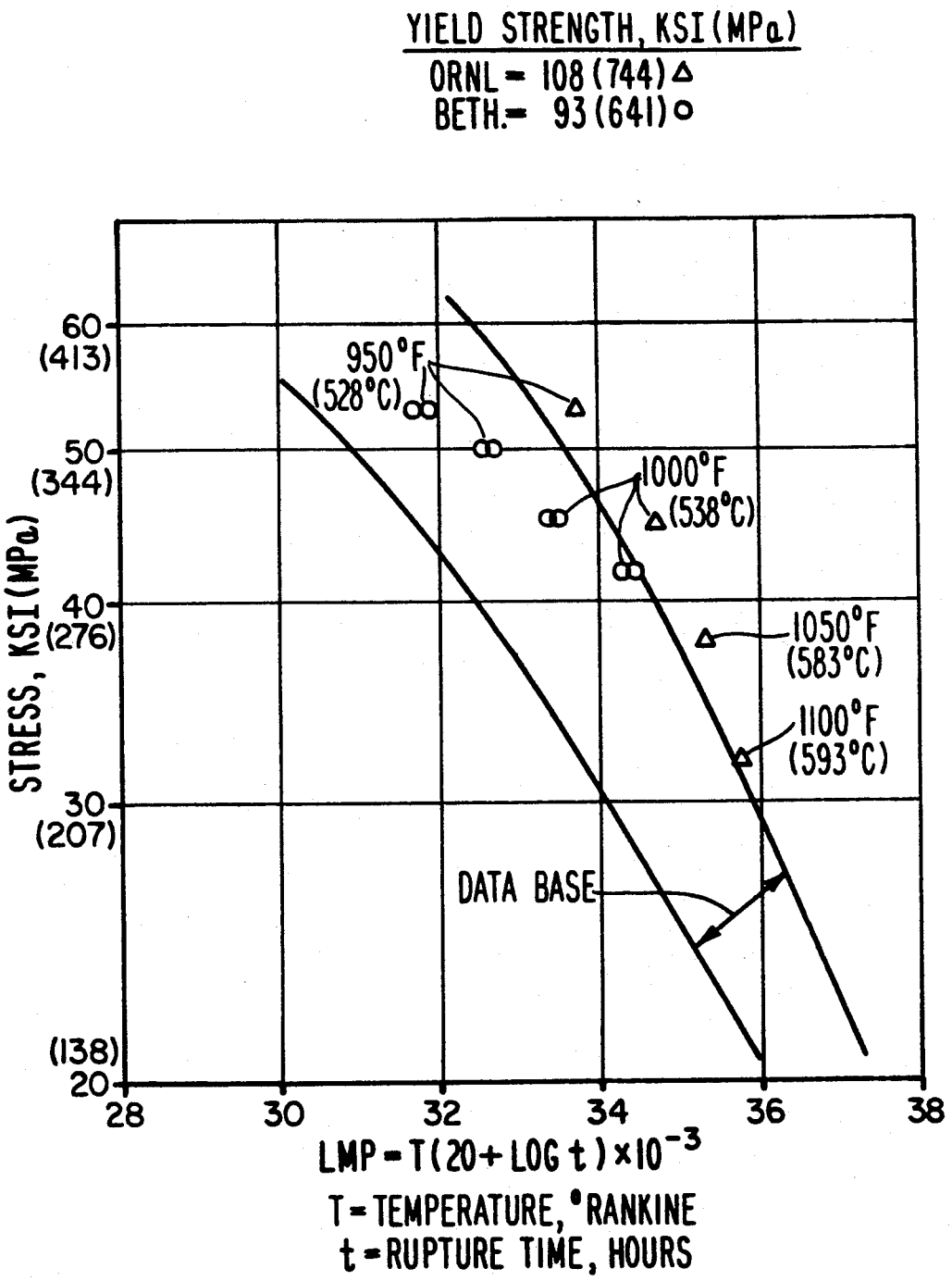
FIG. 2: is a graph depicting stress in ksi versus the Larson Miller Creep Parameter for selected examples of 9Cr-1Mo mod. alloys.

It is noted that the samples included a elongation in the range of about 18–40%, and a reduction of area in a range of about 71–80% which compares favorably with high-temperature Cr-Mo-V alloy samples. It was further demonstrated that on average, 9Cr-1Mo, mod. alloy samples showed improved creep-rupture properties when compared to a data base prepared with Cr-Mo-V alloy samples, see FIG. 2.

From the foregoing, it can be realized that this invention provides improved turbine components, alloy systems, and heat treatments for improving the mechanical properties of power generation turbine rotor alloys. Although various embodiments have been illustrated, this was for the purpose of describing, but not limiting the invention. Various modifications, which will become apparent to one skilled in the art, are within the scope of this invention, described in the attached claims.

We claim:

1. A method of operating an electric power plant having a single alloy system turbine rotor exposed to a high temperature and high pressure steam source and a low temperature and a low pressure exit end, comprising:

providing a single alloy system rotor consisting essentially of a 9Cr-1Mo, mod. alloy which has been normalized and then tempered at an elevated temperature of about 1275°–1300° F. (690°–704° C.) for one hour per inch of its thickness; and operating said rotor in an electric power plant at a power generation turbine service temperature profile of about 75° F. (24° C.) at the exit end up to about 1200° F. (649° C.) at the source, said profile encompassing a high temperature and low temperature profile whereby said high temperature profile is from about 800° F.–1200° F. (427°–649° C.) and said low temperature profile is from about 75° F. to about 800° F. (24°–427° C.).

2. A method of using a single alloy system turbine rotor, exposed to a high temperature and high pressure steam source and a low temperature and low pressure exit end, consisting essentially of an ASTM A182, F91, 9Cr-1Mo, mod. alloy, substantially all of said alloy heat treated from at least about one hour at a temperature of about 1225°–1350° F. (663°–732° C.) for obtaining a $FATT_{50}$ of less than about 80° F. (26.6° C.), comprising: exposing said single alloy system rotor to a power generation turbine service temperature profile of about 75° F. (24° C.) at the exit end up to about 1200° F. (649° C.) at the source said profile encompassing a high temperature and a low temperature profile, wherein the low temperature profile is from about 75°–800° F. and the high temperature profile is from about 800°–1200° F.

3. The method of claim 2 wherein said heat treatment comprises tempering said alloy for about 5–20 hours.

4. The method of claim 3 wherein said tempering comprises heating to a temperature of about 1275°–1300° F. (690°–704° C.).

5. The method of claim 2 wherein said rotor has been substantially normalized at about 1900°–2000° F. (1038°–1093° C.).

6. The method of claim 5 wherein said rotor has been normalized up to about 1 hour per inch of thickness.

7. The method of claim 5 wherein said rotor has been normalized at about 1900° F. (1038° C.) for at least about one hour.

8. The method of claim 2 wherein said rotor has a room temperature 0.2% yield strength of about 80–110 ksi (551–758 MPa).

9. The method of claim 2 wherein said rotor comprises a $FATT_{50}$ below about room temperature.

10. The method of claim 2 wherein said alloy has an elongation of about 18–40% and a reduction in area of about 71–83% for a room temperature tensile test at 0.2% offset.

* * * * *